United States Patent [19]

Karolyi

[11] Patent Number: 4,975,010

[45] Date of Patent: Dec. 4, 1990

[54] PROCESS AND APPARATUS FOR THE PRODUCTION OF BOOK COVERS COMPONENTS

[75] Inventor: Oskar Karolyi, Bad Boll, Fed. Rep. of Germany

[73] Assignee: Michael Horauf Maschinenfabrik GmbH & Co. KG, Donzdorf, Fed. Rep. of Germany

[21] Appl. No.: 265,516

[22] Filed: Nov. 1, 1988

[30] Foreign Application Priority Data

Jan. 15, 1988 [DE] Fed. Rep. of Germany ..... 3800940

[51] Int. Cl.[5] ..... B42C 7/00

[52] U.S. Cl. ..... 412/3; 412/9; 412/23; 100/207

[58] Field of Search ..... 412/3, 15, 23, 9; 493/386, 379, 110, 141, 144, 142, 162, 402, 403; 156/908, 555, 582; 100/207, 208, 210, 173, 160, 161

[56] References Cited

U.S. PATENT DOCUMENTS 2,688,913 9/1954 Mercer et al. ..... 100/207
3,204,986 9/1965 Tooker ..... 412/3
3,720,566 3/1973 Heimann ..... 156/908

OTHER PUBLICATIONS

BDM 20, "Buchdeckenmaschine fur Leistungen von 60 Decken/Minute", Brochure No. D 017.0869, by Maschinenfabrik Michael Horauf Co., West Germany, ( 8 pages).

*Primary Examiner*—Frank T. Yost
*Assistant Examiner*—Hwei-Siu Payer
*Attorney, Agent, or Firm*—Burns, Doane, Swecker & Mathis

[57] ABSTRACT

In the manufacture of a book cover, a cover sheet is glued to cardboard panels and portions of the sheet are folded around edges of the panels. The glued unit is then passed through a press comprising pairs of press rolls spaced apart in the direction of travel of the glued unit. One roll of each pair contains circumferentially spaced recesses along its outer periphery. The recesses prevent the application of pressing forces to the unit when the recesses reach the unit, whereby an interrupted pressing action is achieved. Each pair of rolls is operated to apply pressing forces to regions of the cover not pressed by the other pair of rolls.

7 Claims, 2 Drawing Sheets

PROCESS AND APPARATUS FOR THE PRODUCTION OF BOOK COVERS COMPONENTS

BACKGROUND AND OBJECTS OF THE INVENTION

The invention concerns a process and apparatus for the preparation of book covers.

A process and apparatus for carrying out the process are known from a Brochure No. D 017.0869, which describes a book cover machine designated as BDM 20 of the Maschinenfabrik Michael Horauf Co., West Germany. A mechanism designed therein as a "second contact pressure unit" serves to re-press book covers, the covering sheets of which are glued to cardboard panels and folded around their edges. For this purpose, a so-called re-pressing belt is provided, which passes the book covers through the roll gap of a pair of contact pressure rolls. Re-pressing is carried out continuously per each cover in the sense that re-pressing forces are applied to the edges of the panels in an uninterrupted manner, i.e., once the forces are begun at leading ends of the edges to be pressed, the forces are not relieved until the trailing edges are reached.

With many covering materials, in particular in the case of embossed book coverings, occasionally small folds form at the trailing edge of the cover, which lead to the formation of small voids between the book covering and the corresponding cardboard cover. Such voids are undesirable relative to the appearance and the durability of book covers.

It is an object of the invention to eliminate this disadvantage and to provide a process and an apparatus for the production of book covers, whereby the book coverings will adhere fully to the cardboard covers.

SUMMARY OF THE INVENTION

The invention is based on the discovery by the inventor that the detrimental fold formation occurs as a result of an elongation of the sheet caused by an uninterrupted pressing operation and can be avoided by an interrupted pressing action. Thus, by application of the contact pressure to spaced zones of the cover, the zones being preferably relatively short, no folds are formed in the cover. In accordance with the invention, therefore, the book covers are re-pressed in certain zones only, with the zones that are not re-pressed being located between the re-pressed zones. These non re-pressed zones may, if necessary, then be re-pressed by the application of a second pressure. The frequencies of the pressure applications may be correlated with each other in a manner such that the book cover is being re-pressed over its entire length, but in several steps.

To carry out the novel process in a particularly simple manner, the invention provides that at least one roll of the pair of contact pressure rolls is equipped with a plurality of circumferentially uniformly spaced recesses. These recesses may be in the form of grooves located on the roll periphery. The pairs of contact pressure rolls are thus able to apply pressing forces under a constant load, but those forces will be interrupted in the direction of the edge being pressed. A similarly designed contact pressure roll may follow the first one in series.

The pairs of pressure rolls are conveniently connected with a common drive so that the recessed rolls are driven synchronously. The pressure zone applications thus may be placed in series without gaps.

In an advantageous embodiment of the invention, the spacing between the nips of the two contact pressure roll pairs is shorter than the length of a book cover. This results in the fact that spaced regions of the book cover pass simultaneously through pressure gaps. The unintentional shifting of the zones correlated with the individual pairs of contact pressure rolls is thus prevented.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
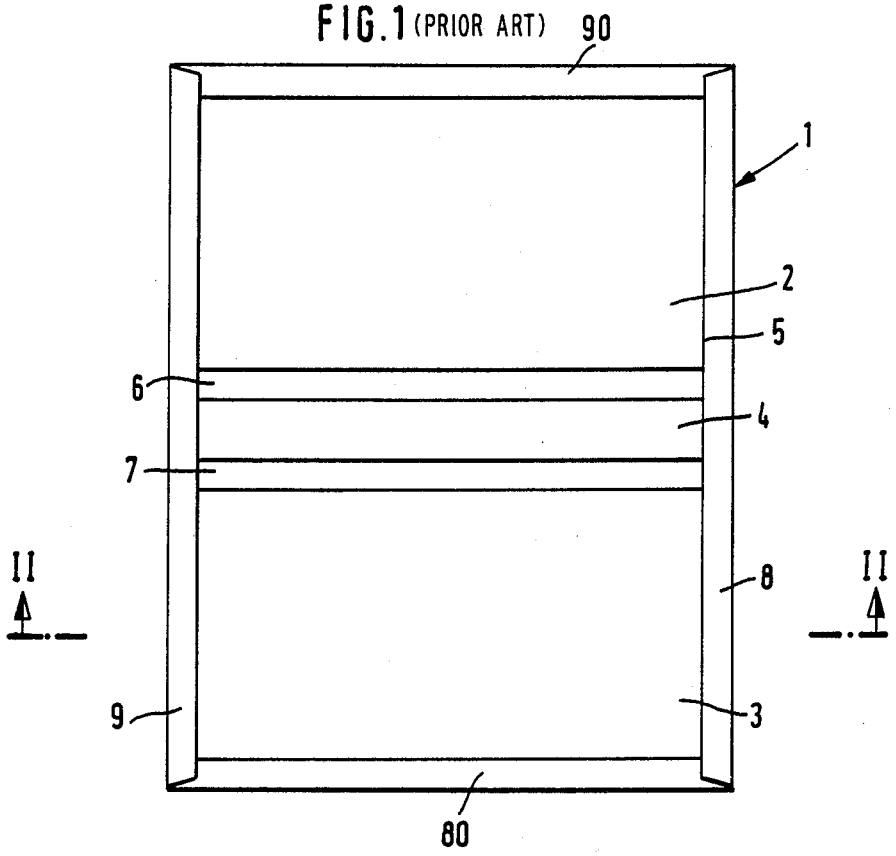
FIG. 1 (PRIOR ART)
FIG. 1 is a top view of the inner side of a book cover.

The book cover 1 shown in FIG. 1 comprises in a known manner, two cardboard panels 2 and 3, and screening 4, glued to a covering sheet 5, the latter made for example of a plastic. Overlapping side and end edges 8, 9 and 80, 90 of the covering sheet 5 are folded in a known manner around the edges of the cardboard panels 2, 3. Between the screening 4 and the cardboard panels 2, 3, small areas 6 and 7 are present, which are not reinforced by any glued-on supplemental material and about which the book covers can be later folded. The material thickness of the screening 4 is preferably less than the thickness of the cardboard panels 2 and 3.

Figure 2:
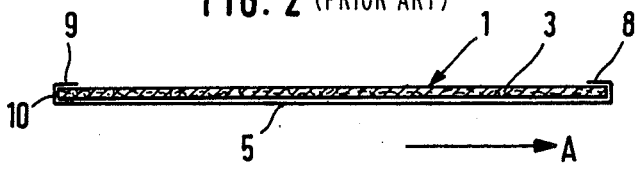
FIG. 2 (PRIOR ART)
FIG. 2 is a cross-sectional view through the book cover of FIG. 1 along the section line II—II.

While the gluing of the screening 4 to the sheet 5 for reinforcing the spine of the book is usually carried out without difficulty, occasionally problems are encountered in the re-pressing of the covering sheet 5 after it is folded around the edges of the cardboard panels 2, 3. It can be seen in the sectioned view of FIG. 2 that the front and rear side edges 8 and 9, respectively, extend transversely to the direction of transport A. During the re-pressing step the trailing fold location 10 considered with reference to the direction A of transport may be susceptible of problems. That is, particularly in the case of embossed sheets 5, small voids or folds may appear in the region of the trailing fold location 10. This is the result of the fact that during an uninterrupted or continuous re-pressing of a book cover 1 in the direction of the arrow A in the pressure gap between two rolls of a contact pressure roll pair, the material of the sheet 5 is slightly elongated in a direction opposite the direction of transport.

Figure 3:
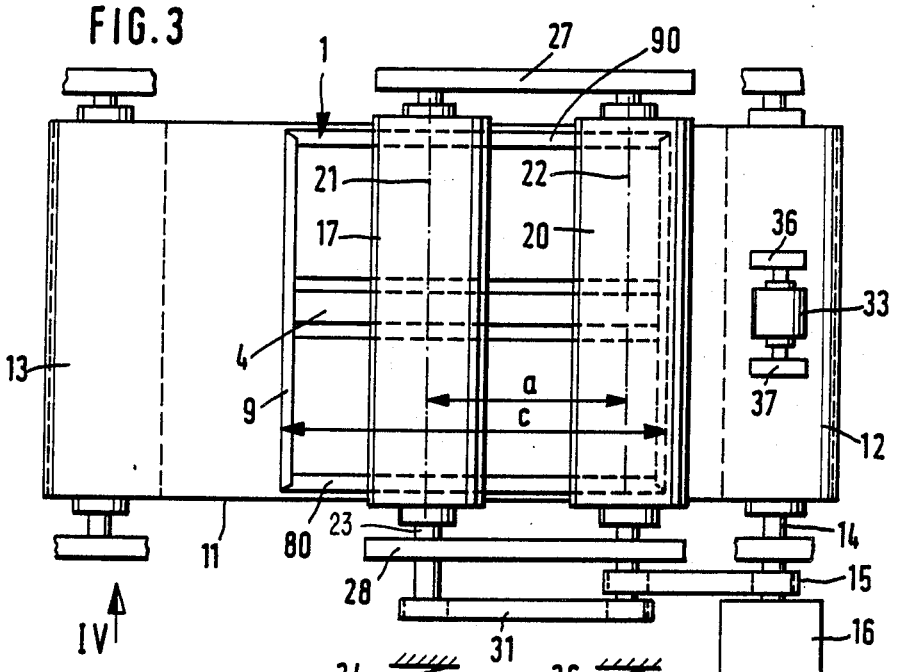
FIG. 3 is a top view of a pressing mechanism according to the invention through which a book cover is being transported.
Figure 4:
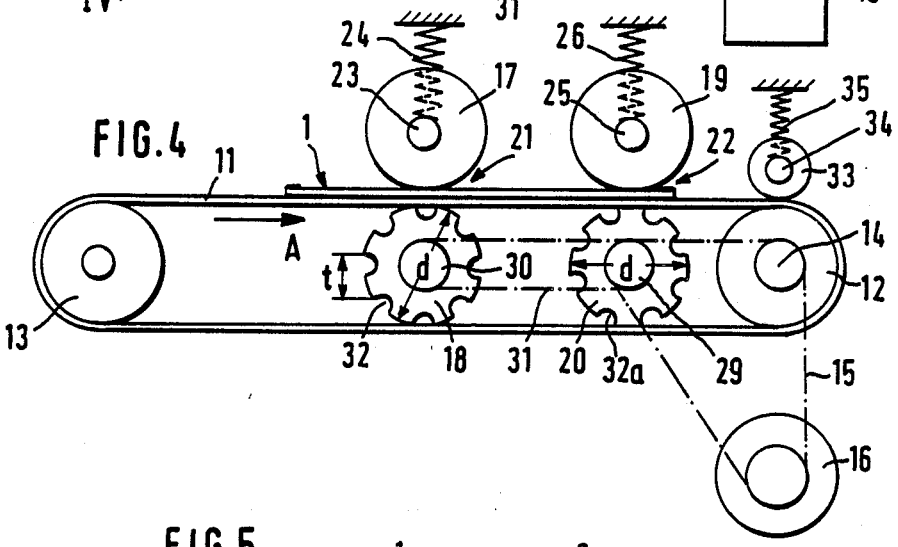
FIG. 4 is a view in the direction of the arrow IV of FIG. 3, with certain structural parts eliminated for the sake of clarity.

FIGS. 3 and 4 depict a re-pressing belt 11 driven in the direction of the arrow A, which belt is arranged in accordance with the invention to avoid the aforedescribed shortcomings.

The re-pressing belt 11 is endless and is guided by two reversing rolls 12 and 13, with the axle 14 of the leading reversing roll 12 being power-driven. A toothed belt 15 is provided for driving the axle 14, the belt 15 being driven by a drive pulley of an electric motor 16. The upper flight of the belt advances book covers, in the direction of transport A, through a pressing station which includes two contact pressure roll pairs 17, 18 and 19, 20,, are located in succession. The book cover 1 is transported through the pressure gap or nip zones 21 and 22 of those roller pairs. The axle 23 of the contact pressure roll 17 is loaded by a spring 24 for generating a clamp pressure. In a corresponding manner, the axle 25 of the pressure roll 19 is loaded by a spring 26.

Alternatively, conventional pneumatically acting contact pressure devices can be provided in place of the springs 24 and 26. Such devices may be set particularly easily to the desired contact pressure and make it possible to adjust the pressure gap 21 and 22 to the thickness of the book covers 1 to be re-pressed. Those pneumatic devices would be capable of acting on holders 27 and 28 (see FIG. 3), in which the ends of axles 23 and 25 of the contact pressure rolls 17 and 19 are supported.

The shaft 29 of the pressure roll 20 is driven by the same toothed belt 15 as the axle 14 of the forward reversing roll 12. The shaft 30 of the pressure roll 18 is driven by another toothed belt 31, which is connected to the shaft 29 of the pressure roll 20. This makes it possible for the pressure rolls 18 and 20 to run in an exactly synchronous manner relative to each other, which is essential for reasons which will become apparent. The contact rolls 17 and 19, acting as pressure rolls are rotated by friction.

Figure 5:
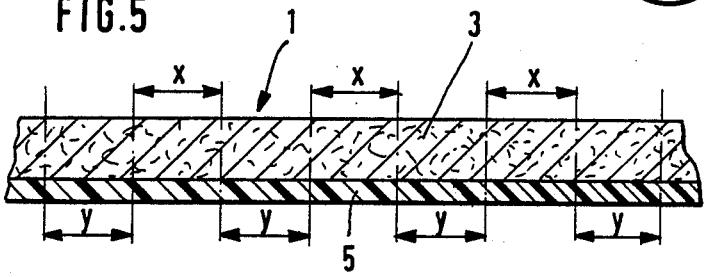
FIG. 5 is an enlarged fragmentary view of the book cover shown in FIG. 2, illustrating individual pressure zones.

According to the invention, the driven pressure rolls 18 and 20 located under the re-pressing belt 11 are provided with recesses **32, 32*a* uniformly distributed over their circumferences. The recesses are in the form of grooves located parallel to the shafts 29, 30 and extending along the entire longitudinal length of the rolls, i.e., the grooves extend parallel to the width of the cover. As a result of those recesses, the clamping pressure at each of the pressure gaps 21, 22 is applied interruptedly, by means of a recurring pressing phase corresponding to the pitch t of the recesses. This interrupted pressing occurs despite the creation of constant loading by the springs 24, 26. Whenever a pressure-relieving recess 32 passes under a contact roll 17, the clamping pressure is reduced to an ineffective level. Thus, at no location along the pressing station are pressing forces applied in a continuously effective manner across the entire width of the corner. With reference to the enlarged representation according to FIG. 5, the clamping pressure of the contact pressure roll pair 17, 18 acts on the book cover 1 only in zones x, which are located between zones y that are not pressed by the roll pair 17, 18**.

By means of the synchronous drive of the pressure rolls 18, 20, the zones y are correlated with the other contact pressure roll pair 19, 20, whereby the pressure roll pair 19, 20 presses the book cover 1 only in the zones y. The arrangement of the pressure roll pairs 17, 18, and 19, 20, and the frequencies of the resulting clamping pressures are correlated so that (i) the zones x and y on each cover follow each other without interruption, and (ii) the pressure modes of the leading and trailing roll pairs are out-of-phase by 180 degrees, i.e., each roll pair is in a pressure mode when the other roll pair is in a non-pressing mode.

If the distance a between the two pressure gaps 21, 22 (FIG. 3) is given a dimension corresponding to the circumference of each pressure roll 18, 20, the recess 32 of the pressure roll 18 will be offset relative to the recess **32*a* of the pressure roll 20 by one-half of a division t in the circumferential direction (assuming that the two pressure rolls 18, 20** have the same diameters and the same division t). This result can be achieved by other distances a, the above distance being exemplary only.

By imparting only an interrupted pressure along relatively short intervals of the cover, the aforedescribed problematic elongations of the sheet 5 are avoided, whereby the trailing edge 10 of the cover is not adversely affected.

The use of two pairs of rolls is desirable because it makes possible the pressing of all portions of the cover, i.e., the avoidance of appreciably long non-pressed regions. However, an acceptable pressing operation could be performed by a single pair of rolls if the length of the pitch t was made small enough so as to minimize the length of the non-pressed regions.

Also, the pressing need not be performed by rolls; other types of pressing mechanisms which apply interrupted pressing forces, could be used.

In actual practice, the pressure rolls 18 and 20 have a diameter d of the order of magnitude of 80 mm. The pitch t may advantageously be on the order of 20 mm.

It was mentioned above that the thickness of the screening 4 is less than the thicknesses of the cardboard panels 2 and 3. For this reason, during the transport of the book cover 1 on the re-pressing belt 11, the screening 4 is not pressed by the pairs of pressure rolls 17, 18, and 19, 20. Rather, for the re-pressing of the screening 4 a narrow re-pressing roll 33 is provided downstream of the contact pressure roll pairs 17, 18 and 19, 20 which, due to a short length, acts on the screening 4 only. The axle 34 of the re-pressing roll 33 is loaded by a spring 35, which acts on axle holders 36 and 37. It has been discovered that the screening 4 can be pressed without difficulty, even if only a single repressing roll 33 is used.

Although the present invention has been described in connection with a preferred embodiment thereof, it will be appreciated by those skilled in the art that modifications, additions, deletions, and substitutions not specifically described may be made without departing from the spirit and scope of the invention as defined in the appended claims.

What is claimed is:

1. Apparatus for pressing together a covering sheet and panels which define a book cover, comprising means for advancing the cover in a direction of travel with the panels glued to the sheet and portions of the sheet folded around edges of the panels, and pressing means for applying pressing forces to the panels and sheet, said pressing means comprising a pair of endless rotary members between which the cover is advanced, one endless rotary member of the pair including circumferentially spaced pressing surfaces along its outer periphery which define therebetween non-pressing regions for interrupting the application of pressing forces intermittently along the cover in the direction of travel.

2. Apparatus according to claim 1, wherein said one endless rotary member comprises a roll arranged to press against the cover, the roll including circumferentially spaced recesses defining the non-pressing regions.

3. Apparatus according to claim 1 including a second pressing means situated downstream of the first-named pressing means for pressing regions of the cover not pressed by the first-named pressing means.

4. Apparatus according to claim 3, wherein said second pressing means includes a second pair of endless rotary members of the same configuration as the first-named pair of endless rotary members, said first-named and second pairs of endless rotary members comprising, respectively, first and second pairs of rolls, at least one roll of each pair of rolls having circumferentially spaced recesses along its outer periphery, the recesses defining said non-pressing regions, the first and second roll pairs being spaced apart in the direction of travel, each roll pair arranged to apply pressing forces whenever the other roll pair applies no pressing forces, each roll pair arranged to apply pressing forces to regions of the cover which are not pressed by the other roll pair.

5. Apparatus according to claim 4 including drive means for rotating the first and second roll paris at synchronous speeds.

6. Apparatus according to claim 4, wherein the first and second roll pairs are spaced apart by a distance shorter than the dimension of the cover in the direction of travel.

7. Apparatus for pressing together a covering sheet and panels which define a book cover, comprising means for advancing the cover with the panels glued to the sheet and portions of the sheet folded around edges of the panels, and pressing means for applying pressing forces to the panels and sheet, said pressing means comprising a pair of rolls between which the cover is advanced, one roll of the roll pair including circumferentially spaced recesses along its outer periphery, the recesses preventing the application of pressing forces to the cover when the recesses reach the cover.

* * * * *